US006748674B2

(12) United States Patent
Ellis, III

(10) Patent No.: US 6,748,674 B2
(45) Date of Patent: Jun. 15, 2004

(54) SHOE SOLE STRUCTURES USING A THEORETICALLY IDEAL STABILITY PLANE

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 0 days.

(21) Appl. No.: 10/288,816

(22) Filed: Nov. 6, 2002

(65) Prior Publication Data

US 2003/0131497 A1 Jul. 17, 2003

Related U.S. Application Data

(62) Division of application No. 08/162,373, filed on Dec. 3, 1993, now Pat. No. 6,609,312, which is a continuation of application No. 07/847,832, filed on Mar. 9, 1992, now abandoned, which is a continuation of application No. 07/469,313, filed on Jan. 24, 1990, now abandoned.

(51) Int. Cl.[7] ..... A43B 13/18
(52) U.S. Cl. ..... 36/25 R
(58) Field of Search ..... 36/25 R, 30 R, 36/28, 31, 32 R, 88, 91, 114, 127, 129, 69

(56) References Cited

U.S. PATENT DOCUMENTS

| | | | |
|---|---|---|---|
| 193,914 | A | 8/1877 | Berry |
| 280,791 | A | 7/1883 | Brooks |
| 288,127 | A | 11/1883 | Shepard |
| 500,385 | A | 6/1893 | Hall |
| 532,429 | A | 1/1895 | Rogers |
| 584,373 | A | 6/1897 | Kuhn |
| 811,438 | A | 1/1906 | Rhodes |
| 1,283,335 | A | 10/1918 | Shillcock |
| 1,289,106 | A | 12/1918 | Bullock |
| D55,115 | S | 5/1920 | Barney |
| 1,458,446 | A | 6/1923 | Shaefer |
| 1,622,860 | A | 3/1927 | Cutler |
| 1,639,381 | A | 8/1927 | Manelas |
| 1,701,260 | A | 2/1929 | Fischer |
| 1,735,986 | A | 11/1929 | Wray |
| 1,853,034 | A | 4/1932 | Bradley |
| 1,870,751 | A | 8/1932 | Reach |
| 2,095,095 | A | 10/1937 | Howard |

(List continued on next page.)

FOREIGN PATENT DOCUMENTS

| | | |
|---|---|---|
| CA | 1176458 | 10/1984 |
| DE | 1918131 | 6/1965 |
| DE | 1918132 | 6/1965 |

(List continued on next page.)

OTHER PUBLICATIONS

Johnson et al., <<A Biomechanicl Approach to the Design of Football Boots>>, *Journal of Biomechanics*, vol. 9, pp. 581–585 (1976).

(List continued on next page.)

*Primary Examiner*—Ted Kavanaugh
(74) *Attorney, Agent, or Firm*—Knoble Yoshida & Dunleavy, LLC

(57) ABSTRACT

A construction for a shoe, particularly an athletic shoe such as a running shoe, includes a sole that is constructed according to an ideal stability plane. Such a shoe sole conforms to the natural shape of the foot, particularly the sides, and has a constant thickness in frontal plane cross sections; the thickness of the shoe sole sides contour equals the thickness of the load-bearing sole portion and therefore varies as the thickness of the load-bearing sole portion varies. Natural stability is provided in negative heel shoe soles that are less thick in the heel area than in the rest of the shoe sole. Also provided is natural stability in flat shoe soles that have no heel lift, maintaining the same thickness throughout. The design avoids excessive structural rigidity by using contoured stability sides abbreviated to only essential structural support elements.

31 Claims, 8 Drawing Sheets

U.S. PATENT DOCUMENTS

| | | | | |
|---|---|---|---|---|
| 2,120,987 | A | 6/1938 | Murray | |
| 2,124,986 | A | 7/1938 | Pipes | |
| 2,147,197 | A | 2/1939 | Glidden | |
| 2,155,166 | A | 4/1939 | Kraft | |
| 2,162,912 | A | 6/1939 | Craver | |
| 2,170,652 | A | 8/1939 | Brennan | |
| 2,179,942 | A | 11/1939 | Lyne | |
| D119,894 | S | 4/1940 | Sherman | |
| 2,201,300 | A | 5/1940 | Prue | |
| 2,206,860 | A | 7/1940 | Sperry | |
| D122,131 | S | 8/1940 | Sannar | |
| D128,817 | S | 8/1941 | Esterson | |
| 2,251,468 | A | 8/1941 | Smith | |
| 2,284,307 | A | 5/1942 | Sperry | |
| 2,328,242 | A | 8/1943 | Witherill | |
| 2,345,831 | A | 4/1944 | Pierson | |
| 2,433,329 | A | 12/1947 | Adler et al. | |
| 2,434,770 | A | 1/1948 | Lutey | |
| 2,470,200 | A | 5/1949 | Wallach | |
| 2,627,676 | A | 2/1953 | Hack | |
| 2,847,769 | A | 8/1958 | Schlesinger | |
| 3,087,261 | A | 4/1963 | Russell | |
| 3,295,230 | A | 1/1967 | Szerenyi et al. | |
| 3,732,634 | A | 5/1973 | Jacobson | |
| 3,824,716 | A | 7/1974 | Di Paolo | |
| 3,834,046 | A | 9/1974 | Fowler | |
| 4,043,058 | A | 8/1977 | Hollister et al. | 36/102 |
| 4,059,910 | A | 11/1977 | Bryden et al. | |
| 4,128,950 | A | 12/1978 | Bowerman et al. | 36/30 |
| 4,149,324 | A | 4/1979 | Lesser et al. | |
| D256,180 | S | 8/1980 | Turner | D2/317 |
| D256,400 | S | 8/1980 | Famolare, Jr. | D2/319 |
| 4,237,627 | A | 12/1980 | Turner | |
| 4,271,606 | A | 6/1981 | Rudy | 36/28 |
| 4,281,467 | A | 8/1981 | Anderie | |
| 4,309,831 | A | 1/1982 | Pritt | |
| 4,309,832 | A | 1/1982 | Hunt | |
| 4,314,413 | A | 2/1982 | Dassier | 36/129 |
| D264,017 | S | 4/1982 | Turner | D2/309 |
| D265,019 | S | 6/1982 | Vermonet | D2/319 |
| D272,294 | S | 1/1984 | Watanabe | D2/309 |
| 4,455,767 | A | 6/1984 | Bergmans | |
| 4,468,870 | A | 9/1984 | Sternberg | |
| D280,568 | S | 9/1985 | Stubblefield | D2/319 |
| 4,542,598 | A | 9/1985 | Misevich et al. | |
| 4,547,979 | A | 10/1985 | Harada et al. | |
| 4,559,723 | A | 12/1985 | Hamy | |
| 4,569,142 | A | 2/1986 | Askinasi | |
| 4,570,362 | A | 2/1986 | Vermonet | |
| 4,620,376 | A | 11/1986 | Talarico, II | |
| 4,624,061 | A | 11/1986 | Wezel et al. | |
| 4,638,577 | A | 1/1987 | Riggs | |
| D289,341 | S | 4/1987 | Turner | D2/322 |
| 4,654,983 | A | 4/1987 | Graham et al. | |
| 4,667,423 | A | 5/1987 | Autry et al. | |
| 4,715,133 | A | 12/1987 | Hartjes et al. | |
| 4,724,622 | A | 2/1988 | Mills | |
| 4,731,939 | A | 3/1988 | Parracho et al. | |
| 4,748,752 | A | 6/1988 | Tanel | |
| 4,748,753 | A | 6/1988 | Ju | |
| 4,769,926 | A | 9/1988 | Meyers | 36/43 |
| 4,777,738 | A | 10/1988 | Giese et al. | |
| D298,684 | S | 11/1988 | Pitchford | D2/264 |
| 4,783,910 | A | 11/1988 | Boys, II et al. | |
| 4,790,083 | A | 12/1988 | Dufour | |
| D302,900 | S | 8/1989 | Kolman et al. | D2/264 |
| 4,858,340 | A | 8/1989 | Pasternak | |
| 4,864,737 | A | 9/1989 | Marrello | |
| 4,866,861 | A | 9/1989 | Noone | |
| 4,890,398 | A | 1/1990 | Thomasson | |
| 4,894,932 | A | 1/1990 | Harada et al. | |
| 4,894,933 | A | 1/1990 | Tonkel et al. | 36/28 |
| 4,897,936 | A | 2/1990 | Fuerst | 36/30 |
| D310,131 | S | 8/1990 | Hase | D2/264 |
| D310,132 | S | 8/1990 | Hase | D2/264 |
| D310,906 | S | 10/1990 | Hase | D2/204 |
| 4,989,349 | A | 2/1991 | Ellis, III | |
| 5,012,597 | A | 5/1991 | Thomasson | |
| 5,014,449 | A | 5/1991 | Richard et al. | |
| 5,025,573 | A | 6/1991 | Giese et al. | |
| 5,048,203 | A | 9/1991 | Kling | |
| D320,302 | S | 10/1991 | Kiyosawa | D2/264 |
| D327,164 | S | 6/1992 | Hatfield | D2/264 |
| D327,165 | S | 6/1992 | Hatfield | D2/264 |
| D328,968 | S | 9/1992 | Tinker | D2/264 |
| D329,528 | S | 9/1992 | Hatfield | D2/264 |
| D329,739 | S | 9/1992 | Hatfield | D2/264 |
| D330,972 | S | 11/1992 | Hatfield et al. | D2/264 |
| D332,344 | S | 1/1993 | Hatfield et al. | D2/264 |
| D332,692 | S | 1/1993 | Hatfield et al. | D2/319 |
| 5,191,727 | A | 3/1993 | Barry et al. | 36/107 |
| 5,224,810 | A | 7/1993 | Pitkin | |
| D347,105 | S | 5/1994 | Johnson | D2/896 |
| 5,369,896 | A | 12/1994 | Frachey et al. | 36/29 |
| D372,114 | S | 7/1996 | Tunre et al. | D2/969 |
| 5,544,429 | A | 8/1996 | Ellis, III | |
| 5,572,805 | A | 11/1996 | Giese et al. | 36/30 |
| D388,594 | S | 1/1998 | Turner et al. | D2/902 |
| D409,362 | S | 5/1999 | Turner et al. | D2/902 |
| D409,826 | S | 5/1999 | Turner et al. | D2/955 |
| D410,138 | S | 5/1999 | Turner et al. | D2/959 |
| 5,909,948 | A | 6/1999 | Ellis, III | |
| D444,293 | S | 7/2001 | Turner et al. | D2/958 |
| D450,916 | S | 11/2001 | Turner et al. | D2/896 |

FOREIGN PATENT DOCUMENTS

| | | |
|---|---|---|
| DE | 1685260 | 5/1966 |
| DE | 2036062 | 7/1970 |
| DE | 1948620 | 5/1971 |
| DE | 1685293 | 7/1971 |
| DE | 2045430 | 3/1972 |
| DE | 2522127 | 11/1976 |
| DE | 2525613 | 12/1976 |
| DE | 2602310 | 7/1977 |
| DE | 2613312 | 10/1977 |
| DE | 2654116 | 1/1979 |
| DE | 3021936 | 4/1981 |
| DE | 8219616.8 | 9/1982 |
| DE | 3113295 | 10/1982 |
| DE | 3245182 | 12/1982 |
| DE | 3317462 | 5/1983 |
| DE | 831831.7 | 12/1984 |
| DE | 3347343 | 7/1985 |
| DE | 8530136.1 | 2/1988 |
| EP | 0207063 | 10/1986 |
| FR | 1245672 | 10/1960 |
| GB | 1504615 | 3/1978 |
| GB | 2076633 | 12/1981 |
| GB | 2133668 | 8/1984 |
| JP | 1129505 | 6/1986 |
| JP | 2136505 | 5/1990 |
| JP | 2279103 | 11/1990 |
| JP | 3086101 | 4/1991 |
| WO | WO8707481 | 12/1987 |

OTHER PUBLICATIONS

Fixx, *The Complete Book of Running*, pp. 134–137 1977.

Romika Catalog, Summer 1978.

Adidas shoe, Model <<Water Competition>> 1980.

World Professional Squash Association Pro Tour Program, 1982–1983.
Williams et al., <<The Mechanics of Foot Action During The GoldSwing and Implications for Shoe Design>>, *Medicine and Science in Sports and Exercise*, vol.15, No. 3, pp 247–255 1983.
Nigg et al., <<Biomechanical Aspects of Sport Shoes and Playing Surfaces>>, *Proceedings of the International Symposium on Biomechanical Aspects of Sport Shoes and Playing Surfaces*, 1983.
Valiant et al., <<A Study of Landing from a Jump : Implications for the Design of a Basketball Shoe>>, *Scientific Program of IX International Congress of Biomechanics*, 1983.
Frederick, *Sports Shoes and Playing Surfaces, Biomechanical Properties*, Entire Book, 1984.
Saucony Spot–bilt Catalog Supplement, Spring 1985.
Adidas shoe, Model <<Fire>> 1985.
Adidas shoe, Model "Tolio H.", 1985.
Adidas shoe, Model "Buffalo" 1985.
Adidas shoe, Model, "Marathon 86" 1985.
Adidas shoe, Model <<Boston Super>> 1985.
Leuthi et al., <<Influence of Shoe Construction on Lower Extremity Kinematics and Load During Lateral Movements In Tennis>>, *International Journal of Sport Biomechanics*, vol. 2, pp 166–174 1986.
Nigg et al., *Biomechanics of Running Shoes*, entire book, 1986.
Runner's World, Oct. 1986.
AVIA Catalog 1986.
Brooks Catalog 1986.
Adidas Catalog 1986.
Adidas shoe, Model <<Questar>>, 1986.
Adidas shoe, Model "London" 1986.
Adidas shoe, Model <<Marathon>> 1986.
Adidas shoe, Model <<Tauern>> 1986.
Adidas shoe, Model <<Kingscup Indoor>>, 1986.
Komi et al., "Interaction Between Man and Shoe in Running: Considerations for More Comprehensive Measurement Approach", *International Journal of Sports Medicine*, vol. 8, pp. 196–202 1987.
Nigg et al., <<The Influence of Lateral Heel Flare of Running Shoes on Protraction and Impact Forces>>, Medicine and Science in Sports and Excercise, vol. 19, No. 3, pp. 294–302 1987.
Nigg, <<Biomechanical Analysis of Ankle and foot Movement>> *Medicine and Sport Science*, vol. 23, pp 22–29 1987.
Saucony Spot–bilt shoe, *The Complete Handbook of Athletic Footwear*, pp 332, 1987.
Puma basketball shoe, *The Complete Handbook of Athletic Footwear*, pp 315, 1987.
Adidas shoe, Model, <<Indoor Pro>> 1987.
Adidas Catalog, 1987.
Adidas Catalog, Spring 1987.
Nike Fall Catalog 1987, pp 50–51.
Footwear Journal, Nike Advertisement, Aug. 1987.
Sporting Goods Business, Aug. 1987.
Nigg et al., "Influence of Hell Flare and Midsole Construction on Pronation" *International Journal of Sport Biomechanics*, vol. 4, No. 3, pp 205–219, (1987).
Vagenas et al., <<Evaluationm of Rearfoot Asymmetrics in Running With Worn and New Running Shoes <<, *International Journal of Sport Biomechanics*, vol. 4, No. 4, pp 352–357 (1988).
Fineagan, "Comparison of the Effects of a Running Shoe and A Racing Flat on the Lower Extremity Biomechanical Alignment of Runners", *Journal of the American Physical Therapy Association*, vol., 68, No. 5, p 806 (1988).
Nawoczenside et al., <<Effect of Rocker Sole Design on Plantar Forefoot Pressures>> *Journal of the American Podiatric Medical Association*, vol. 79, No. 9, pp 455–460, 1988.
Sprts Illustrated, Special Preview Issue, The Summer Olympics <<Seoul '88>> Reebok Advertistement.
Sports Illustrated, Nike Advertisement, Aug. 8, 1988.
Runner's World, "Shoe Review" Nov. 1988 pp 46–74.
Footwear Nows, Special Supplement, Feb. 8, 1988.
Footwear New, vol. 44, No. 37, Nike Advertisement (1988).
Saucony Spot–bilt Catalog 1988.
Runner's World, Apr. 1988.
Footwear News, Special Supplement, Feb. 8, 1988.
Kronos Catalog, 1988.
Avia Fall Catalog 1988.
Nike shoe, Model <<High Jump 88>>, 1988.
Nike shoe, Model <<Zoom Street Leather>> 1988.
Nike shoe, Model, <<Leather Cortex®>>, 1988.
Nike shoe, Model <<Air Revolution>> #15075, 1988.
Nike shoe, Model "Air Force" #1978, 1988.
Nike shoe, Model <<Air Flow<< #718, 1988.
Nike shoe, Model "Air" #1553, 1988.
Nike shoe, Model <<Air>>, #13213 1988.
Nike shoe, Model <<Air>>, #4183, 1988.
Nike Catalog, Footwear Fall, 1988.
Adidas shoe Model "Skin Racer" 1988.
Adidas shoe, Model <<Tennis Comfort>> 1988.
Adidas Catalog 1988.
Segesser et al., "Surfing Shoe", *The Shoe in Sport*, 1989, (Translation of a book published in Germany in 1987), pp 106–110.
Palamarchuk et al., "In shoe Casting Technique for Specialized Sports Shoes", *Journal of the America, Podiatric Medical Association*, vol. 79, No. 9, p 462–465 1989.
Runner's World, "Spring Shoe Survey", pp 45–74.
Footwear News, vol. 45, No. 5, Nike Advertisement 1989.
Nike Spring Catalog 1989 pp 62–63.
Prince Cross–Sport 1989.
Adidas Catalog 1989.
Adidas Spring Catalog 1989.
Adidas Autumn Catalog 1989.
Nike Shoe, men's cross–training Model "Air Trainer SC" 1989.
Nike shoe, men's cross–training Model <<Air Trainer TW>> 1989.
Adidas shoe, Model "Torsion Grand Slam Indoor", 1989.
Adidas shoe, Model <<Torsion ZC 9020 S>> 1989.
Adidas shoe, Model <<Torison Special HI>> 1989.
Areblad et al., <<Three–Dimensional Measurement of Rearfoot Motion During Running>> *Journal of Biomechanics*, vol., 23, pp 933–940 (1990).
Cavanagh et al., "Biomechanics of Distance Running", Human Kinetics Books, pp 155–164 1990.
Adidas Catalog 1990.
Adidas Catalog 1991.
K–Swiss Catalog, Fall 1991.

Adidas' First Supplemental Responses to Interrogatory No. 1.

Complaint, Anatomic Research, Inc. and Frampton E. Ellis v. adidas America, Inc. Civil Action No. 01–1781–A.

Answer and Counterclaim of Defendant adidas America, Inc., Anatomic Research, Inc. And Frampton E. Ellis v. adidas America, Inc. Civil Action No. 01–1781–A dated Dec. 14, 2001.

Complaint, Anatomic Research, Inc. V. adidas America, Inc. Adidas Salomon North America, Inc. Adidas Sales, Inc. And adidas Promotional Retail Operations, Inc. Civil Action No. 2 :01cv960.

Answer and Counterclaim, Anatomic Research, Inc. V. adidas America, Inc. Adidas Salomon North America, Inc. Adidas Sales, Inc. And adidas Promotional Retail Oeprations, Inc. Civil Action No. 2 :01cv960 dated Jan. 14, 2002.

Adidas America, Inc. v. Anatomic Research, Inc. and Frampton E. Ellis III, adidas America Inc.'s Responses to Defendants' First Set of Interrogatories dated Jan. 28, 2002.

Adidas' Second Supplemental Responses to Interrogatory No. 1.

*Runner's World*, 11/88, p. 75.

*Runner's World*, 10/87, p. 60.

*In Search of the Perfect Shoe*, Joe Henderson, Runner's World Magazine, Feb. 1975, pp. 24 and 25.

Adidas Track Spikes (see photos); sale date, pre–Jan. 24, 1989.

FIG. 9A
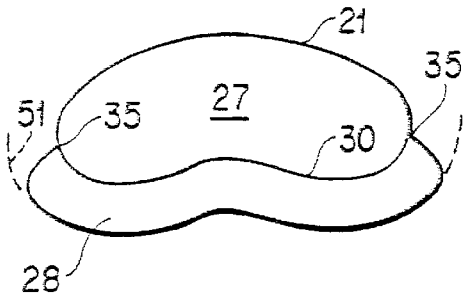
FIG. 9B
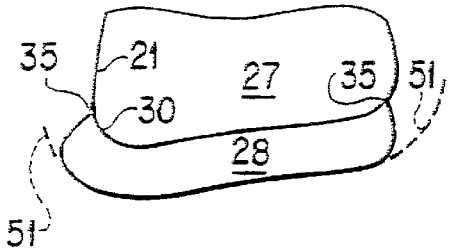
FIG. 9C
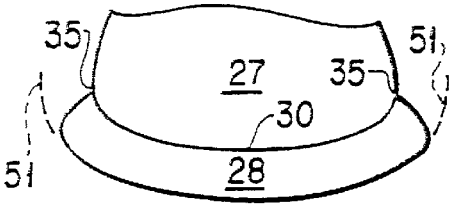
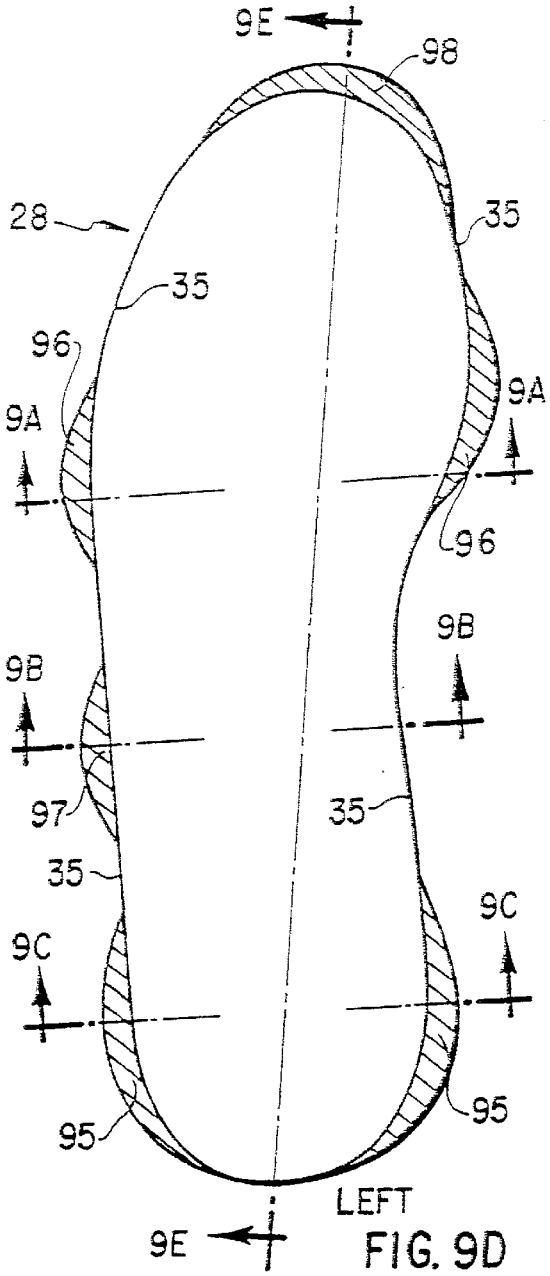
FIG. 9D
FIG. 9E
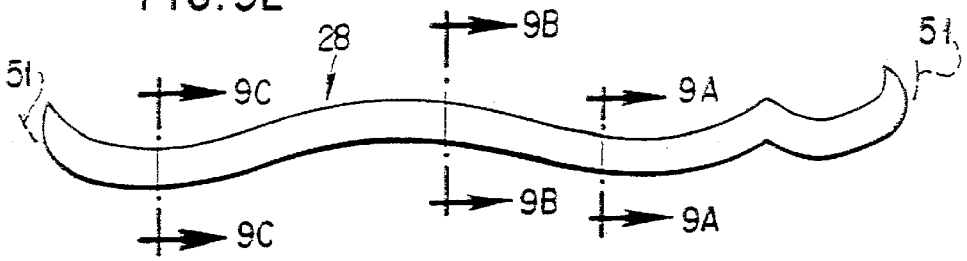

SHOE SOLE STRUCTURES USING A THEORETICALLY IDEAL STABILITY PLANE

CROSS REFERENCE TO RELATED APPLICATIONS

This application is a divisional of U.S. patent application Ser. No. 08/162,373, filed Dec. 3, 1993, now U.S. Pat. No. 6,609,312; which, in turn, is a continuation of U.S. patent application Ser. No. 07/847,832, filed Mar. 9, 1992, now abandoned; which, in turn, is a continuation of U.S. patent application Ser. No. 07/469,313, filed Jan. 24, 1990, now abandoned.

BACKGROUND OF THE INVENTION

This invention relates generally to the structure of shoes. More specifically, this invention relates to the structure of athletic shoes. Still more particularly, this invention relates to variations in the structure of such shoes using the applicant's prior invention of a theoretically-ideal stability plane as a basic concept. Still more particularly, this invention relates to the use of the theoretically ideal stability plane concept to provide stability in negative heel shoe soles that are less thick in the heel area than in the rest of the shoe sole. Still more particularly, this invention also relates to the use of the theoretically ideal stability plane concept to provide natural stability in flat shoe soles that have no heel lift, thereby maintaining the same thickness throughout; excessive structural rigidity being avoided with contoured stability sides abbreviated to only essential structural support elements to provide the shoe sole with natural flexibility paralleling that of the human foot.

The applicant has introduced into the art the general concept of a theoretically ideal stability plane as a structural basis for shoe designs. That concept as implemented into shoes such as street shoes and athletic shoes is presented in pending U.S. application Ser. Nos. 07/219,387, filed on Jul. 15, 1988; 07/239,667, filed on Sep. 2, 1988; 07/400,714, filed on Aug. 30, 1989; 07/416,478, filed on Oct. 3, 1989, and 07/424,509, filed Oct. 20, 1989, as well as in PCT application No. PCT/US89/03076 filed on Jul. 14, 1989. This application develops the application of the concept of the theoretically ideal stability plane to other shoe structures.

The purpose of the theoretically ideal stability plane as described in these pending applications was primarily to provide a neutral design that allows for natural foot and ankle biomechanics as close as possible to that between the foot and the ground, and to avoid the serious interference with natural foot and ankle biomechanics inherent in existing shoes.

In its most general form, the concept of the theoretically ideal stability plane is that the thickness of contoured stability sides of shoe soles, typically measured in the frontal plane, should equal the thickness of the shoe sole underneath the foot. The pending applications listed above all use figures which show that concept applied to embodiments of shoe soles with heel lifts, since that feature is standard to almost all shoes. Moreover, the variation in the sagittal plane thickness caused by the heel lifts of those embodiments is one of the primary elements in the originality of the invention.

However, the theoretically ideal stability plane concept is more general than those specific prior embodiments. It is clear that the concept would apply just as effectively to shoes with unconventional sagittal plane variations, such as negative heel shoe soles, which are less thick in the heel than the forefoot. Such shoes are not common: the only such shoe with even temporarily widespread commercial success was the Earth Shoe, which has not been produced since the mid-1970's.

The lack of success of such shoes may well have been due to problems unrelated to the negative heel. For example, the sole of the Earth Shoe was constructed of a material that was so firm that there was almost no forefoot flexibility in the plane, as is normally required to accommodate the human foot's flexibility there; in addition, the Earth Shoe sole was contoured to fit the natural shape of the wearer's load-bearing foot sole, but the rigid sole exaggerated any inexactness of fit between the wearer and the standard shoe size.

In contrast, a properly constructed negative heel shoe sole may well have considerable value in compensating for the effect of the long term adverse effect of conventional shoes with heel lifts, such as high heel shoes. Consequently, effectively designed negative heel shoe soles could become more widespread in the future and, if so, their stability would be significantly improved by incorporating the theoretically ideal stability plane concept that is the basis of the applicant's prior inventions.

The stability of flat shoe soles that have no heel lift, maintaining the same thickness throughout, would also be greatly improved by the application of the same theoretically ideal plane concept.

For the very simplest form of shoe sole, that of a Indian moccasin of single or double sole, the standard test of originally would obviously preclude any claims of new invention. However, that simple design is severely limited in that it is only practical with very thin soles. With sole thickness that is typical, for example, of an athletic shoe, the moccasin design would have virtually no forefoot flexibility, and would obstruct that of the foot.

The inherent problem of the moccasin design is that the U shape of the moccasin sole in the frontal plane creates a composite sagittal plane structure similar to a simple support beam designed for rigidity; the result is that any moccasin which is thick soled is consequently highly rigid in the horizontal plane.

The applicant's prior application Ser. No. 07/239,667, filed on Sep. 2, 1988, includes an element to counteract such unnatural rigidity: abbreviation of the contoured stability sides of the shoe sole to only essential structural support and propulsion elements. The essential structural support elements are the base and lateral tuberosity of the calcaneus, the heads of the metatarsals, and the base of the fifth metatarsal. The essential propulsion element is the head of the first distal phalange.

Abbreviation of the contoured sides of the shoe sole to only essential structural elements constitutes an original approach to providing natural flexibility to the double sole moccasin design, overcoming its inherent limitation of thin soles. As a result, it is possible to construct naturally stable shoe soles that are relatively thick as is conventional to provide good cushioning, particularly for athletic and walking shoes, and those shoe soles can be natural in the fullest sense; that is, without any unnatural heel lift, which is, of course, an invention dating from the Sixteenth Century.

Consequently, a flat shoe sole with abbreviated contour sides would be the most neutral design allowing for natural foot and ankle biomechanics as close as possible to that between the foot and the ground and would avoid the serious interference with natural foot and ankle biomechanics inherent in existing shoes. Such a shoe sole would have uniform thickness in the sagittal plane, not just the frontal plane.

Accordingly, it is a general object of this invention to elaborate upon the application of the principle of the theoretically ideal stability plane to other shoe structures.

It is another general object of this invention to provide a shoe sole which applies the theoretically ideal stability plane concept to provide natural stability to negative heel shoe soles that are less thick in the heel area than in the rest of the shoe sole.

It is still another object of this invention to provide a shoe sole which applies the theoretically ideal stability plane concept to flat shoe soles that have no heel lift, maintaining the same thickness throughout; excessive structural rigidity being avoided with contoured stability sides abbreviated to only essential structural support elements to provide the shoe sole with natural flexibility paralleling that of the human foot.

It is still another object of this invention to provide a shoe sole wherein the abbreviation of essential structural support elements can also be applied to negative heel shoe soles, again to avoid excessive rigidity and to provide natural flexibility.

These and other objects of the invention will become apparent from a detailed description of the invention which follows taken with the accompanying drawings.

BRIEF DESCRIPTION OF THE DRAWINGS

In the drawings:

FIG. 7A is a cross sectional view of the forefoot portion taken along lines 7A of FIG. 7D; FIG. 7B is a view taken along lines 7B of FIG. 7D; FIG. 7C is a view taken along the heel along lines 7C in FIG. 7D; and FIG. 7D is a top view of the shoe sole with the thicker forefoot section shown hatched.

FIG. 8A shows the same embodiment as FIG. 7.

FIGS. 7 and 8 disclose a shoe sole (28) having a sole inner surface (30) adjacent the location of an intended wearer's foot (27) inside the shoe including at least a first concavely rounded portion (43), as viewed in a frontal plane, the concavity being determined relative to the location of an intended wearer's foot (27) inside the shoe, during an upright, unloaded shoe condition. The shoe sole (28) further includes a lateral or medial sidemost section (45) defined by that part of the side of the shoe sole (28) located outside of a straight line (55) extending vertically from a sidemost extent (46) of the sole inner surface (30), as viewed in the frontal plane during a shoe upright, unloaded condition, an outer surface (31) extending from the sole inner surface (30) and defining the outer boundary of the sidemost section (45) of the side of the shoe sole (28), as viewed in the frontal plane. The shoe sole (28) further including a second concavely rounded portion (44) forming at least the outer sole surface (31) of the sidemost section (45), the concavity being determined relative to the location of an intended wearer's foot (27) inside the shoe, as viewed in the frontal plane during a shoe upright, unloaded condition. The second concavely rounded portion (44) extending through a sidemost extent (47) of the sole outer surface (31) of the sole sidemost section (45), as viewed in the frontal plane during an upright, unloaded condition. A forefoot are (50) of the shoe sole (28) has a greater thickness ($s+s^1$) than the thickness(s) of a heel area (51) of the shoe sole (28), as viewed in a sagittal plane, as shown in FIG. 8, during an unloaded, upright shoe condition. The shoe sole (28) also including a sole midtarsal area (52) located between the forefoot area (50) and the heel area (51).

FIGS. 7 and 8 also show a shoe sole (28) having a sole inner surface (30) adjacent the location of an intended wearer's foot (27) inside the shoe with at least a first concavely rounded portion (43), the concavity being determined relative to the location of an intended wearer's foot (27) inside the shoe, as viewed in a frontal plane in a heel area (51) of the shoe sole (28), during an upright, unloaded shoe condition. The shoe sole (28) also includes a sole outer surface (31) extending from the sole inner surface (30) and having at least a second concavely rounded portion (44), the concavity being determined relative to the location of an intended wearer's foot (27) inside the shoe, as viewed in the frontal plane on the heel area (51) during a shoe upright, unloaded condition. The second concavely rounded portion (44) extends to a height above a horizontal line (48) through the lowermost point of the sole inner surface (30) of the side of the shoe sole (28) having the second concavely rounded portion, as viewed in the frontal plane in the heel area (51) during an upright, unloaded shoe condition. The shoe sole (28) having a greater thickness ($s+s^1$) in a forefoot area (50) than the thickness (s) in a heel sole area (51), as viewed in a sagittal plane, as shown in FIG. 8, during a shoe upright, unloaded condition. The centerline (49) of the shoe sole (28) is shown in FIG. 7.

FIGS. 9A–9D shows the applicant's other new invention of the use of the theoretically ideal stability plane concept applied to a flat shoe sole that have no heel lift, maintaining the same thickness throughout, with contoured stability sides abbreviated to only essential structural support elements. FIG. 9A is a cross sectional view of the forefoot portion taken along lines 9A of FIG. 9D; FIG. 9B is a view taken along lines 9B of FIG. 9D; FIG. 9C is a view taken along the heel along lines 9C in FIG. 9D; FIG. 9D is a top view of the shoe sole with the sides that are abbreviated to essential structural support elements shown hatched; and FIG. 9E is a sagittal plane cross section.

DETAILED DESCRIPTION OF THE PREFERRED EMBODIMENTS

Figure 1:
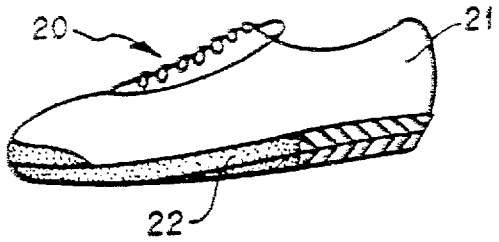
FIG. 1 (PRIOR ART)
FIG. 1 is a perspective view of a typical running shoe known to the prior art to which the invention is applicable.

FIG. 1 is a perspective view of an athletic shoe, such as a typical running shoe, according to the prior art, wherein a running shoe 20 includes an upper portion 21 and a sole 22.

Figure 2:
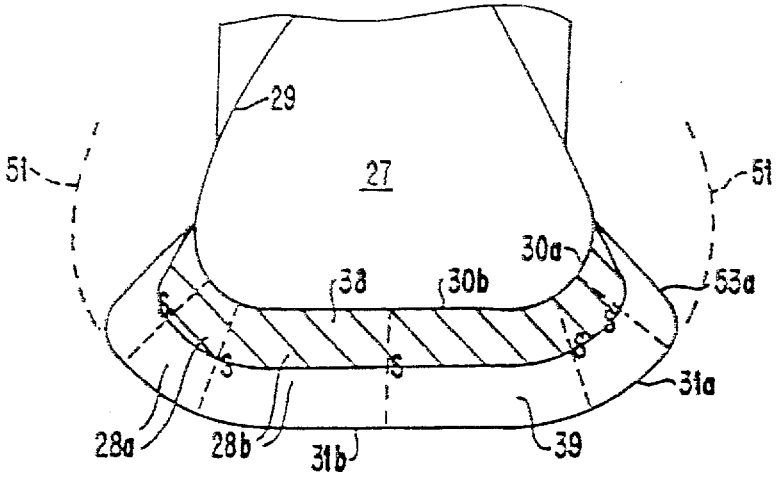
FIG. 2 shows, in frontal plane cross section at the heel portion of a shoe, the applicant's prior invention of a shoe sole with naturally contoured sides based on a theoretically ideal stability plane.
Figure 3:
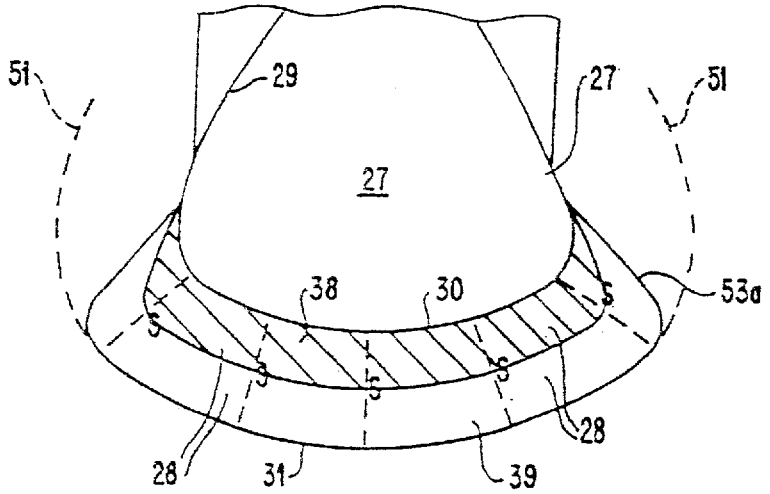
FIG. 3 shows, again in frontal plane cross section, the most general case of the applicant's prior invention, a fully contoured shoe sole that follows the natural contour of the bottom of the foot as well as its sides, also based on the theoretically ideal stability plane.
Figure 4:
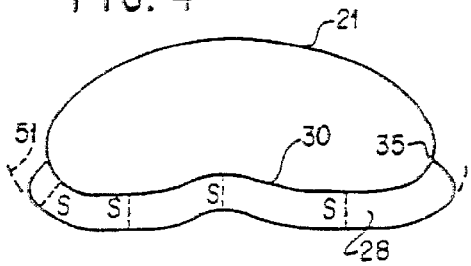
FIG. 4 shows, again in frontal plane cross section of the metatarsal or forefoot arch, an intermediate case of the applicant's prior invention, between those shown in FIGS. 3 and 4 wherein the naturally contoured sides design is extended to the other natural contours underneath the load-bearing foot; such contours include the main longitudinal arch.

FIGS. 2, 3, and 4 show frontal plane cross sectional views of a shoe sole according to the applicant's prior inventions based on the theoretically ideal stability plane, taken at about the ankle joint to show the heel section of the shoe. In the figures, a foot 27 is positioned in a naturally contoured shoe having an upper 21 and a sole 28. The concept of the theoretically ideal stability plane, as developed in the prior applications as noted, defines the plane 51 in terms of a locus of points determined by the thickness (s) of the sole. The reference numerals are like those used in the prior pending applications of the applicant mentioned above and which are incorporated by reference for the sake of completeness of disclosure, if necessary.

FIG. 2 shows, in a rear cross sectional view, the application of the prior invention, described in pending U.S. application Ser. No. 07/239,667, showing the inner surface of the shoe sole conforming to the natural contour of the load-bearing foot and the thickness of the shoe sole remaining constant in the frontal plane, so that the outer surface coincides with the theoretically ideal stability plane. In other words, the outer surface parallels the inner surface in the frontal plane.

FIG. 3 shows a fully contoured shoe sole design of the applicant's prior invention, described in the same pending application, that follows the natural contour of all of the foot, the bottom as well as the sides, while retaining a constant shoe sole thickness in the frontal plane; again, the inner surface of the shoe sole that conforms to the shape of the foot is paralleled in the frontal plane by the outer surface of the bottom sole.

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 3 would deform by flattening to look essentially like FIG. 2. Seen in this light, the naturally contoured side design in FIG. 2 is a more conventional, conservative design that is a special case of the more general fully contoured design in FIG. 3, which is the closest to the natural form of the foot, but the least conventional. The amount of deformation flattening used in the FIG. 2 design, which obviously varies under different loads, is not an essential element of the applicant's invention.

FIGS. 2 and 3 both show in frontal plane cross sections the essential concept underlying this invention, the theoretically ideal stability plane, which is also theoretically ideal for efficient natural motion of all kinds, including running, jogging or walking. FIG. 3 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29.

For the special case shown in FIG. 2, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 2, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*.

In summary, the theoretically ideal stability plane is the essence of the applicant's prior invention because it is used to determine a geometrically precise bottom contour of the shoe sole based on a top contour that conforms to the contour of the foot. This prior invention specifically claims the exactly determined geometric relationship just described.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

FIG. 4, also described in pending U.S. application Ser. No. 07/239,667, illustrates in frontal plane cross section the naturally contoured sides design extended to the other natural contours underneath the load-bearing foot; the metatarsal or forefoot arch is shown, but other such underneath contours include the main longitudinal arch and the ridge between the heads of the distal phalanges (toes).

Figure 5:
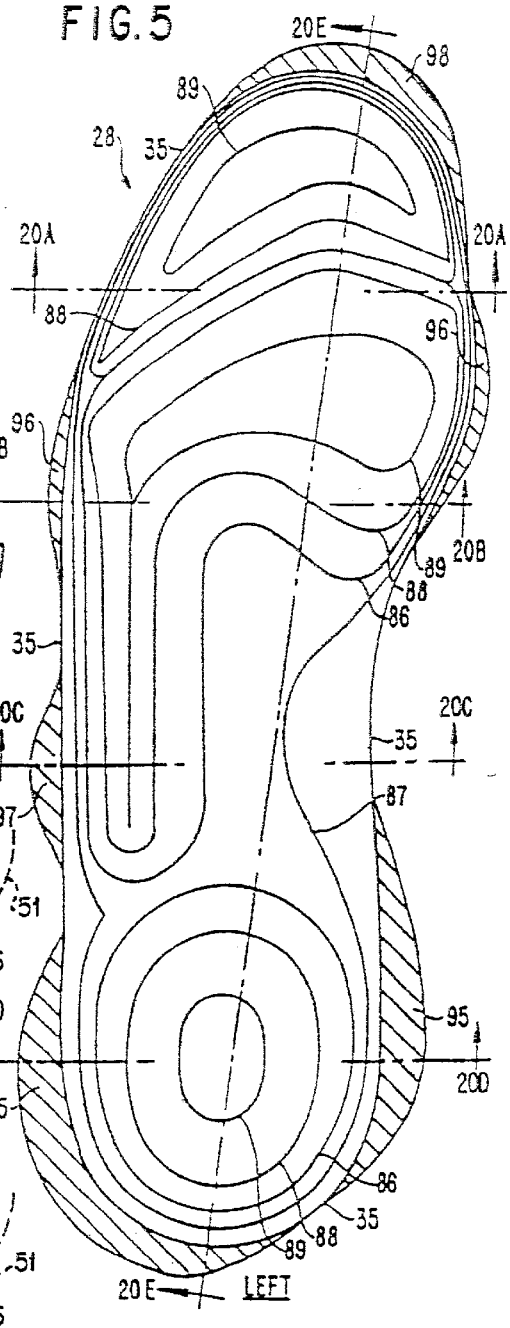
FIG. 5 shows in top view the applicant's prior invention of abbreviation of contoured sides to only essential structural support and propulsion elements (shown hatched), as applied to the fully contoured design shown in FIG. 3.

FIG. 5 shows the applicant's prior invention of contour sides abbreviated to essential structural elements, also described in pending U.S. application Ser. No. 07/239,667, as applied to the fully contoured design of FIG. 3. FIG. 5 shows the horizontal plane top view of fully contoured shoe sole of the left foot abbreviated along the sides to only essential structural support and propulsion elements (shown hatched). Shoe sole material density can be increased in the unabbreviated essential elements to compensate for increased pressure loading there. The essential structural support elements are the base and lateral tuberosity of the calcaneus 95, the heads of the metatarsals 96, and base of the fifth metatarsal 97. They must be supported both underneath and to the outside for stability. The essential propulsion element is the head of the first distal phalange 98. The medial (inside) and lateral (outside) sides supporting the base of the calcaneus are shown in FIG. 5 oriented along either side of the horizontal plane subtalar ankle joint axis, but can be located also more conventionally along the longitudinal axis of the shoe sole. FIG. 5 shows that the naturally contoured stability sides need not be used except in the identified essential areas. Weight savings and flexibility improvements can be made by omitting the non-essential stability sides. Contour lines 85 through 89 show approximately the relative height of the shoe sole contours within roughly the peripheral extent 36 of the undeformed load-bearing shoe sole 28*b*. A horizontal plane bottom view (not shown) of FIG. 5 would be the exact reciprocal or converse of FIG. 5 with the peaks and valleys contours exactly reversed.

Figure 6A:
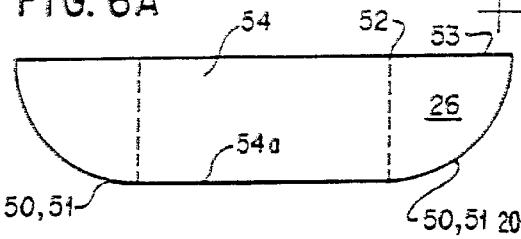
FIGS. 6A to 6C, as seen in FIGS. 6A to 6C in frontal plane cross section at the heel, shows the applicant's prior invention for conventional shoes, a quadrant-sided shoe sole, based on a theoretically ideal stability plane.
Figure 6B:
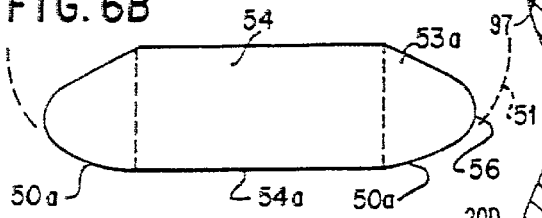
Figure 6C:
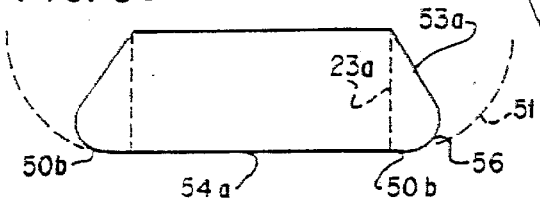

FIG. 6 illustrates in frontal plane cross section a final variation of the applicant's prior invention, described in pending U.S. application Ser. No. 07/219,387, that uses stabilizing quadrants 26 at the outer edge of a conventional shoe sole 28*b* illustrated generally at the reference numeral 28. The stabilizing quadrants would be abbreviated in actual embodiments as shown in FIGS. 6B and 6D.

FIG. 7 shows the applicant's new invention of using the theoretically ideal stability plane concept to provide natural stability in negative heel shoe soles that are less thick in the heel area than in the rest of the shoe sole; specifically, a negative heel version of the naturally contoured sides conforming to a load-bearing foot design shown in FIG. 2.

Figure 7A:
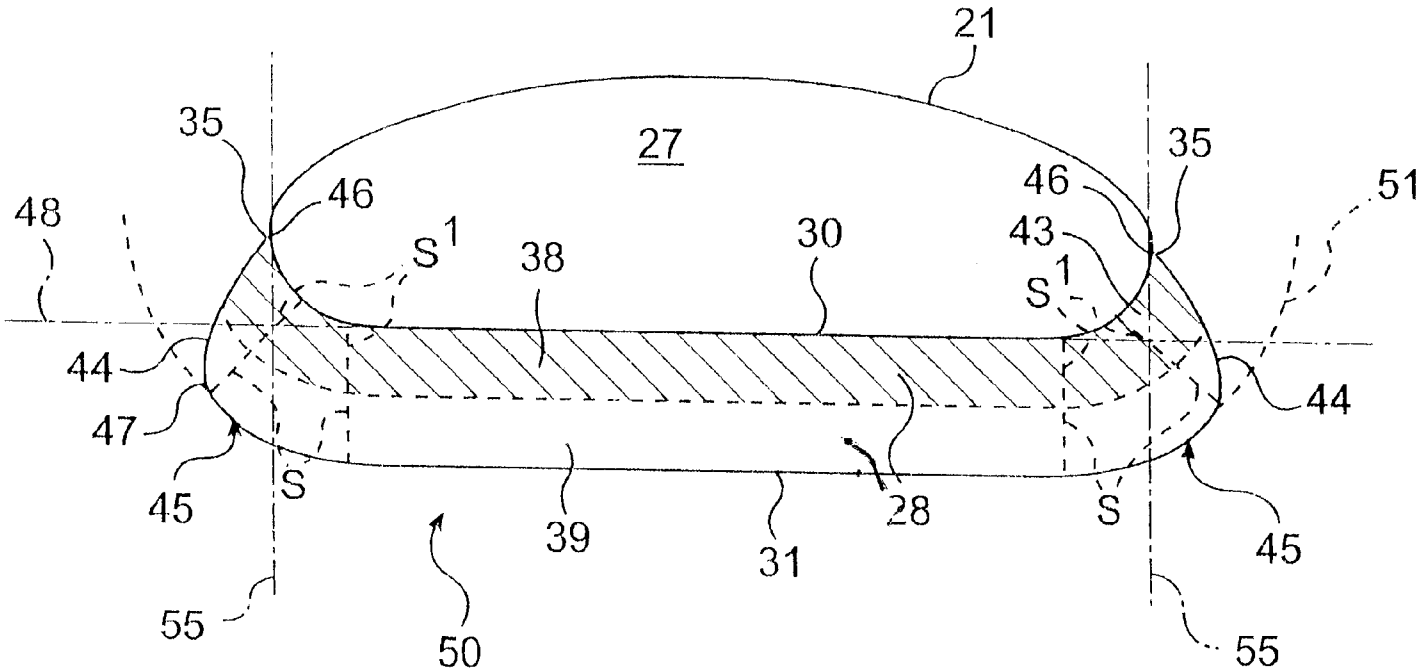
FIGS. 7A–7D shows the applicant's new invention of the use of the theoretically ideal stability plane concept applied to a negative heel shoe sole that is less thick in the heel area than in the rest of the shoe sole.
Figure 7B:
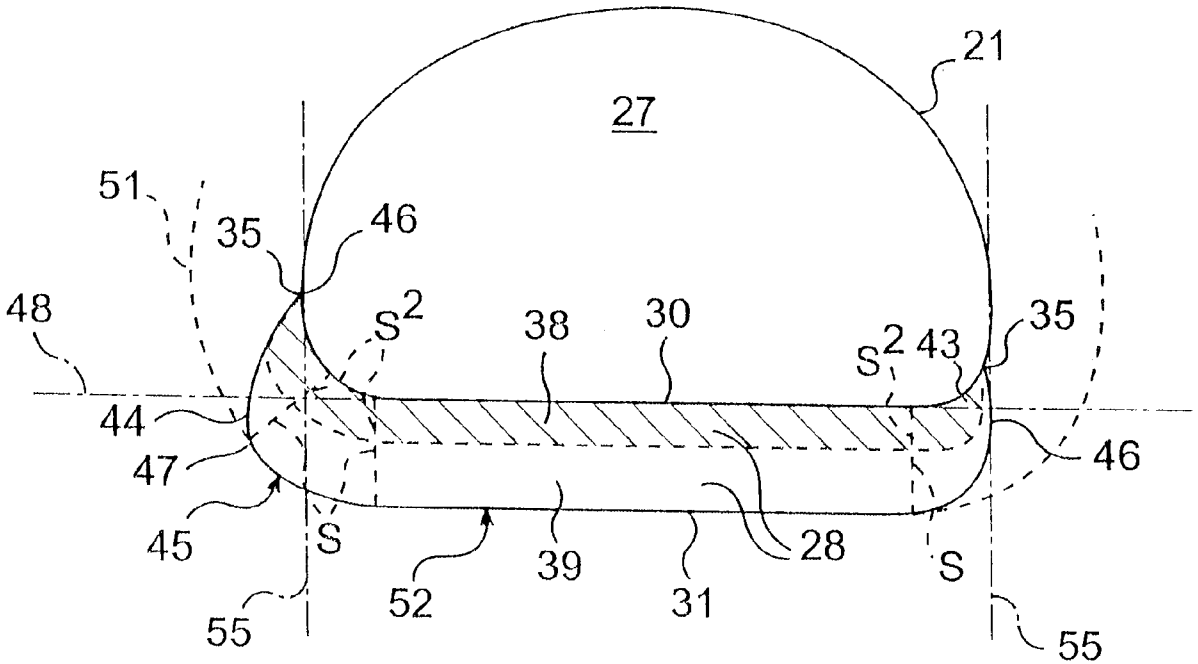
Figure 7C:
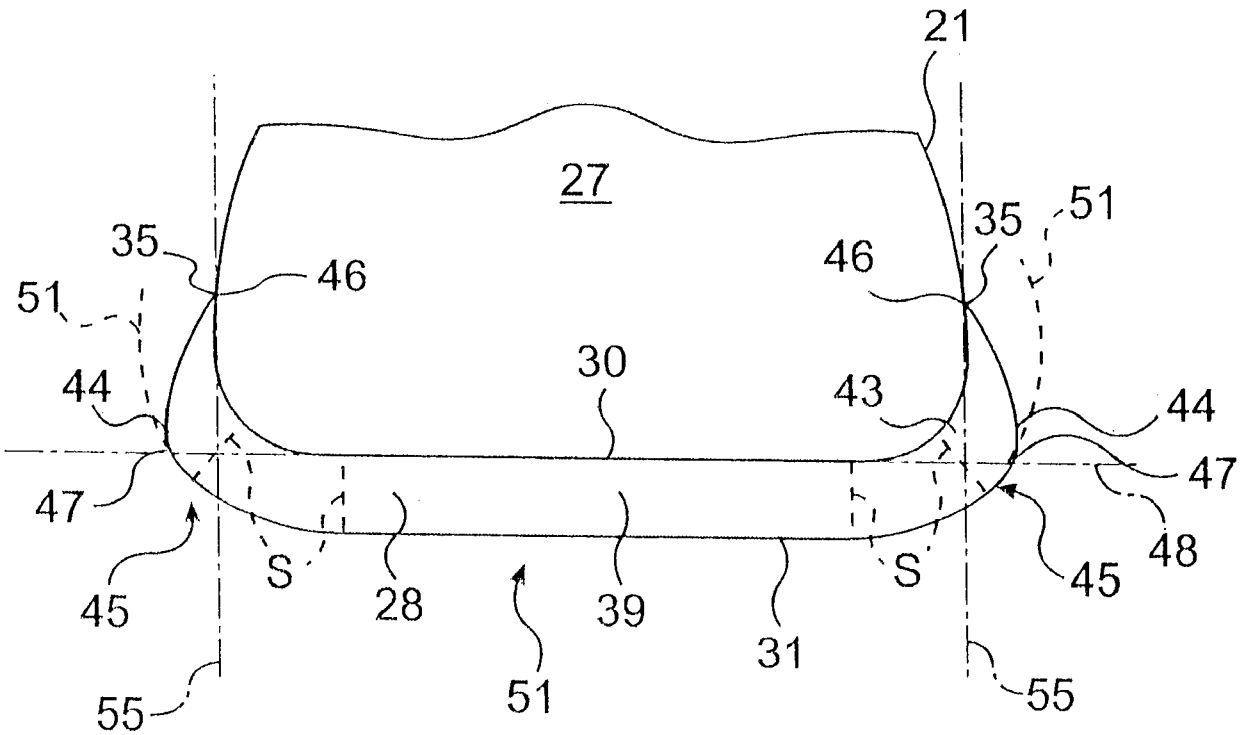
Figure 7D:
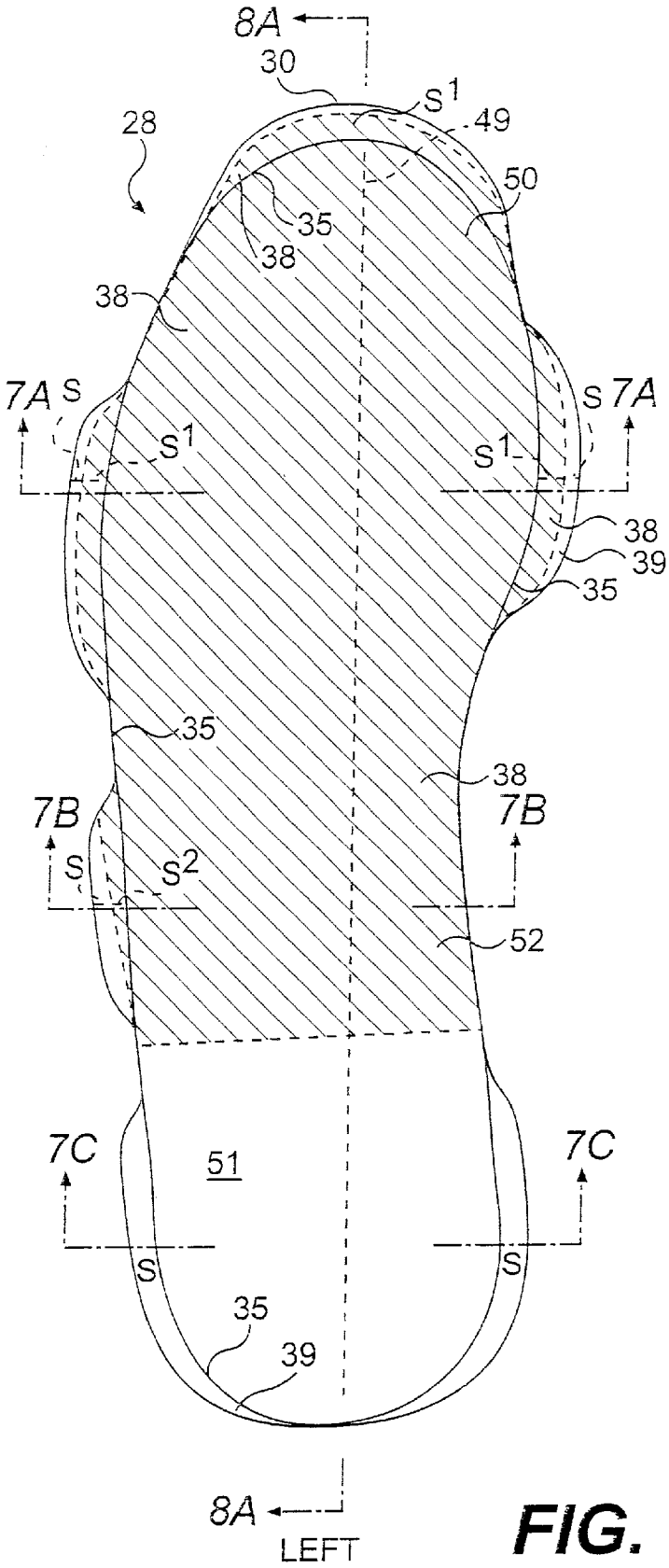

FIGS. 7A, 7B and 7C represent frontal plane cross sections taken along the forefoot, at the base of the fifth metatarsal, and at the heel, thus illustrating that the shoe sole thickness is constant at each frontal plane cross section, even though that thickness varies from front to back, due to the sagittal plane variation 38 (shown hatched) causing a lower heel than forefoot, and that the thickness of the naturally contoured sides is equal to the shoe sole thickness in each FIGS. 7A–7C cross section. Moreover, in FIG. 7D, a horizontal plane overview or top view of the left foot sole, it can be seen that the horizontal contour of the sole follows the preferred principle in matching, as nearly as practical, the rough footprint of the load-bearing foot sole.

The abbreviation of essential structural support elements can also be applied to negative heel shoe soles such as that shown in FIG. 7 and dramatically improves their flexibility. Negative heel shoe soles such as FIG. 7 can also be modified by any of the applicant's prior inventions described in pending U.S. application Ser. Nos. 07/219,387, filed on Jul. 15, 1988; 07/239,667, filed on Sep. 2, 1988; 07/400,714, filed on Aug. 30, 1989; 07/416,478, filed on Oct. 3, 1989, and 07/424,509, filed Oct. 20, 1989

Figure 8A:
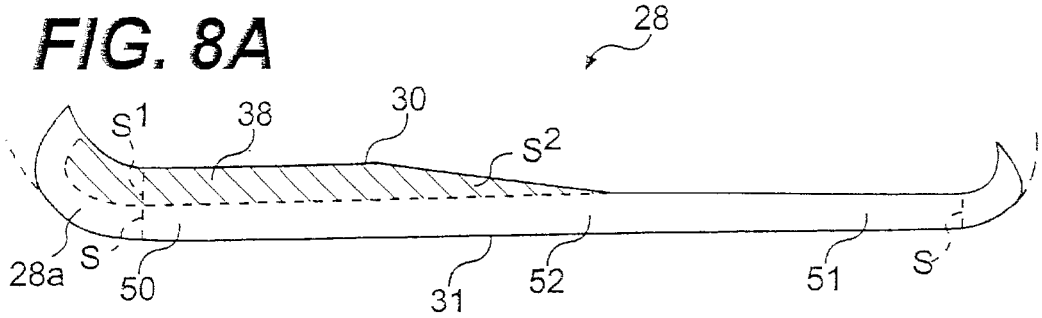
FIGS. 8A–8E shows, a plurality of side sagittal plane cross sectional views of examples of negative heel sole thickness variations to which the general approach shown in FIG. 7 can be applied.
Figure 8B:
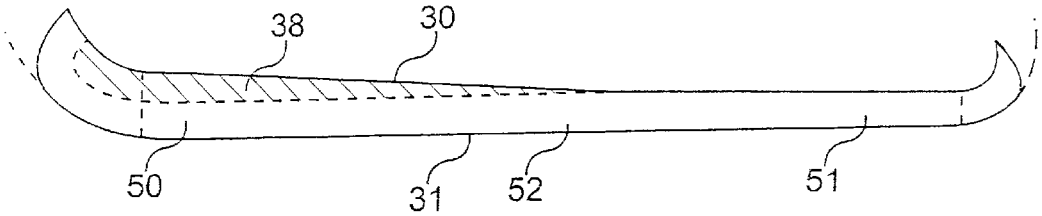
Figure 8C:
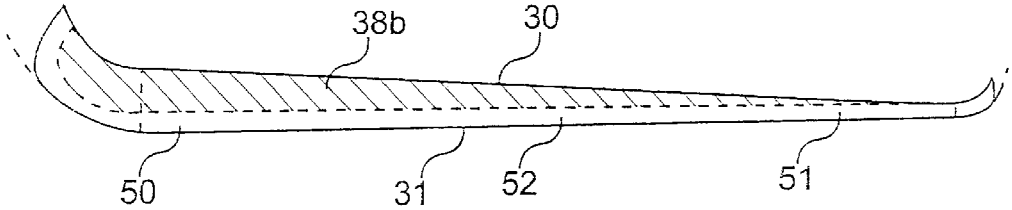
Figure 8D:
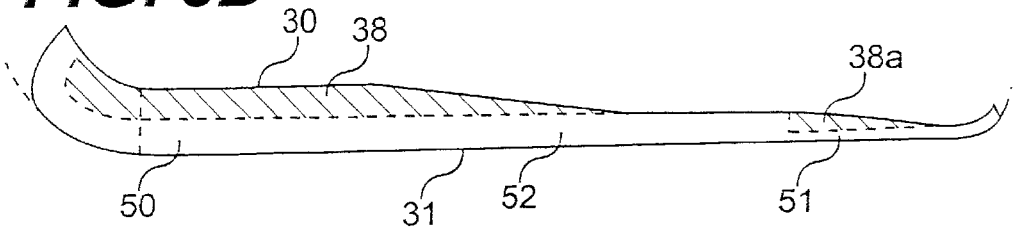
Figure 8E:
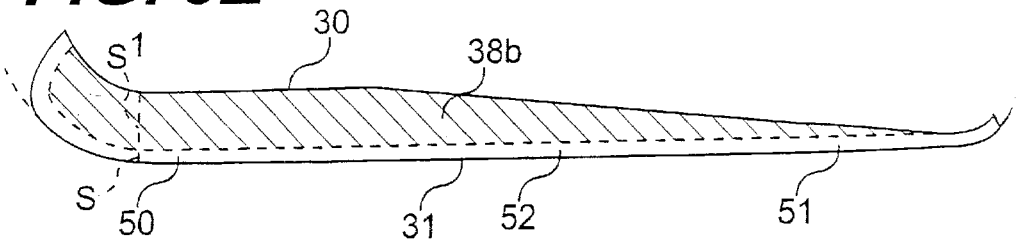

FIG. 8 shows, in FIGS. 8A–8D, possible sagittal plane shoe sole thickness variations for negative heel shoes. The hatched areas indicate the forefoot lift or wedge 38 and a combined midsole and outersole 39. At each point along the shoe soles seen in sagittal plane cross sections, the thickness varies as shown in FIGS. 8A–8D, while the thickness of the naturally contoured sides 28*a*, as measured in the frontal plane, equal and therefore vary directly with those sagittal plane thickness variations. FIG. 8A shows the same embodiment as FIG. 7.

FIG. 9 shows the applicant's new invention of using the theoretically ideal stability plane concept to provide natural stability in flat shoe soles that have no heel lift, maintaining the same thickness throughout, with contoured stability sides abbreviated to only essential structural support elements to provide the shoe sole with natural flexibility paralleling that of the human foot.

FIGS. 9A, 9B and 9C represent frontal plane cross sections taken along the forefoot, at the base of the fifth metatarsal, and at the heel, thus illustrating that the shoe sole thickness is constant at each frontal plane cross section, while constant in the sagittal plane from front to back, so that the heel and forefoot have the same shoe sole thickness, and that the thickness of the naturally contoured sides is equal to the shoe sole thickness in each FIGS. 9A–9C cross section. Moreover, in FIG. 9D, a horizontal plane overview or top view of the left foot sole, it can be seen that the horizontal contour of the sole follows the preferred principle in matching, as nearly as practical, the rough footprint of the load-bearing foot sole. FIG. 9E, a sagittal plane cross section, shows that shoe sole thickness is constant in that plane.

FIG. 9 shows the applicant's prior invention of contour sides abbreviated to essential structural elements, as applied to a flat shoe sole. FIG. 9 shows the horizontal plane top view of fully contoured shoe sole of the left foot abbreviated along the sides to only essential structural support and propulsion elements (shown hatched). Shoe sole material density can be increased in the unabbreviated essential elements to compensate for increased pressure loading there. The essential structural support elements are the base and lateral tuberosity of the calcaneus 95, the heads of the metatarsals 96, and base of the fifth metatarsal 97. They must be supported both underneath and to the outside for stability. The essential propulsion element is the head of the first distal phalange 98. The medial (inside) and lateral (outside) sides supporting the base and lateral tuberosity of the calcaneus are shown in FIG. 9 oriented in a conventional way along the longitudinal axis of the shoe sole, in order to provide direct structural support to the base and lateral tuberosity of the calcaneus, but can be located also along either side of the horizontal plane subtalar ankle joint axis. FIG. 9 shows that the naturally contoured stability sides need not be used except in the identified essential areas. Weight savings and flexibility improvements can be made by omitting the non-essential stability sides. A horizontal plane bottom view (not shown) of FIG. 9 would be the exact reciprocal or converse of FIG. 9 with the peaks and valleys contours exactly reversed.

Flat shoe soles such as FIG. 9 can also be modified by any of the applicant's prior inventions described in pending U.S. application Ser. Nos. 07/219,387, filed on Jul. 15, 1988; 07/239,667, filed on Sep. 2, 1988; 07/400,714, filed on Aug. 30, 1989; 07/416,478, filed on Oct. 3, 1989, and 07/424,509, filed Oct. 20, 1989

What is claimed is:

1. An athletic shoe sole for a shoe, the athletic shoe sole comprising:

a sole heel area of the athletic shoe sole at a location substantially corresponding to the location of a heel of an intended wearer's foot when inside the shoe;

a sole forefoot area at a location substantially corresponding to the location of a forefoot of an intended wearer's foot when inside the shoe;

a sole midtarsal area located between the sole heel area and the sole forefoot area;

the sole heel, midtarsal, and forefoot areas each having a sole medial side, a sole lateral side, and a sole middle part located between the sole sides, as viewed in a shoe sole frontal plane during a shoe unloaded, upright condition;

a sole inner surface adjacent an intended wearer's foot location inside the shoe having at least a first concavely rounded portion, said concavity being determined relative to an intended wearer's foot location inside the shoe, as viewed in a frontal plane located in the sole forefoot area, during an unloaded, upright shoe condition;

the sole lateral side including a sidemost lateral section at a location outside of a straight vertical line extending through the sole lateral side at the sidemost extent of the sole inner surface of the sole lateral side, as viewed in a shoe sole frontal plane during an unloaded, upright shoe condition;

the sole medial side including a sidemost medial section at a location outside of a straight vertical line extending through the sole medial side at the sidemost extent of the sole inner surface of the sole medial side, as viewed in a shoe sole frontal plane during an unloaded, upright shoe condition;

a sole outer surface extending from the sole inner surface and defining the outer boundary of each shoe sole side, as viewed in a frontal plane;

a second concavely rounded portion forming a part of the sole outer surface of the sole side that extends through a lowermost portion of the sole outer surface of one of the lateral and medial sole sides, the concavity being determined relative to an intended wearer's foot location inside the shoe, as viewed in the frontal plane during an unloaded, upright shoe condition;

the sole forefoot area including the following combined components: a forefoot lift, a midsole component and an outsole component, the inner and outer boundaries of the combined components being formed by said sole inner and outer surfaces, as viewed in a shoe sole frontal plane in the sole forefoot area, during an unloaded, upright shoe condition;

the sole forefoot area of the shoe sole having a greater thickness than the sole heel area, as viewed in a sagittal plane during an unloaded, upright shoe condition;

the thickness of the shoe sole being defined as the distance between the sole inner surface and the sole outer surface, as viewed in the sagittal plane during an unloaded, upright shoe condition;

at least one of said combined components extending into the sidemost section of at least the sole side of the sole forefoot area having the concavely rounded inner and outer surface portions, as viewed in a shoe sole frontal plane during an unloaded, upright shoe condition, and at least an upper part of one of said combined components extending into the sidemost section of the sole side of the sole forefoot area having the concavely rounded inner and outer surface portions extending up the sole side at least to the height of a lowest point of the sole inner surface of the same shoe sole side, as viewed in the shoe sole frontal plane during an upright, unloaded shoe condition.

2. A shoe sole as claimed in claim 1, wherein at least a side portion of an area of the shoe sole located between said first concavely rounded portion of the sole inner surface and said second concavely rounded portion of the sole outer surface has a substantially uniform thickness extending to proximate a sidemost extent of a shoe sole side, as viewed in a frontal plane cross-section when the shoe sole is upright and in an unloaded condition.

3. A shoe sole as claimed in claim 1, wherein at least a side portion of an area of the shoe sole located between said concavely rounded portion of the sole inner surface and said concavely rounded portion of the sole outer surface has a substantially uniform thickness extending through an arc of at least 30 degrees, as viewed in a frontal plane cross-section when the shoe sole is upright and in an unloaded condition.

4. A shoe sole as claimed in claim 1, wherein at least a first side portion of an area of the shoe sole located between said concavely rounded portion of the sole inner surface and said concavely rounded portion of the sole outer surface has a first substantially uniform thickness extending to proximate a sidemost extent of a shoe sole side, as viewed in a first frontal plane cross-section when the shoe sole is upright and in an unloaded condition, and at least a second side portion of an area of the shoe sole located between a concavely rounded portion of the sole inner surface and a concavely rounded portion of the sole outer surface has a second, different substantially uniform thickness extending to proximate a sidemost extent of a shoe sole side, as viewed in a second frontal plane cross-section when the shoe sole .is upright and in an unloaded condition.

5. An athletic shoe sole for a shoe, the athletic shoe sole comprising:

a sole heel area of the athletic shoe sole at a location substantially corresponding to the location of a heel of an intended wearer's foot when inside the shoe;

a sole forefoot area at a location substantially corresponding to the location of a forefoot of an intended wearer's foot when inside the shoe;

a sole midtarsal area located between the sole heel area and the sole forefoot area;

the sole heel, midtarsal, and forefoot areas each having a sole medial side, a sole lateral side, and a sole middle part located between the sole sides, as viewed in a shoe sole frontal plane during a shoe unloaded, upright condition;

a sole inner surface adjacent an intended wearer's foot location inside the shoe having at least a first concavely rounded portion, the concavity being determined relative to an intended wearer's foot location inside the shoe, as viewed in a frontal plane in the sole heel area during an unloaded, upright shoe condition;

a sole outer surface extending from the sole inner surface and having at least a second concavely rounded portion, the concavity being determined relative to an intended wearer's foot location inside the shoe, as viewed in the frontal plane in the sole heel area during the upright, unloaded condition;

the second concavely rounded portion extending to a lowermost portion of one of the lateral and medial sole sides, as viewed in the frontal plane during a shoe upright, unloaded condition;

the sole lateral side including a sidemost lateral section at a location outside of a straight vertical line extending through the sole lateral side at the sidemost extent of the sole inner surface of the sole lateral side, as viewed in the shoe sole frontal plane during an unloaded, upright shoe condition;

the sole medial side including a sidemost medial section at a location outside of a straight vertical line extending through the sole medial side at the sidemost extent of the sole inner surface of the sole medial side, as viewed in the shoe sole frontal plane during an unloaded, upright shoe condition;

the sole heel area including the following combined components: a midsole component and an outsole component, the inner and outer boundaries of the combined components being formed by said sole inner and outer surfaces, as viewed in a shoe sole frontal plane during an unloaded, upright shoe condition;

the sole forefoot area having a greater thickness than the sole heel area, as viewed in a sagittal plane, during an unloaded, upright shoe condition;

the thickness of the shoe sole being defined as the distance between the sole inner surface and the sole outer surface, as viewed in the sagittal plane during an unloaded, upright shoe condition;

said combined components extending into the sidemost section of at least the sole side of the sole heel area having the concavely rounded inner and outer surface portions, as viewed in the shoe sole frontal plane during an unloaded, upright shoe condition, and at least an upper part of said combined components that extend into the sidemost section of the sole side of the sole heel area having the concavely rounded inner and outer surface portions extending up the sole side at least to a height of a lowest point of the sole inner surface of the same sole side, as viewed in the shoe sole frontal plane during an upright, unloaded shoe condition.

6. A shoe sole as claimed in claim 5, wherein at least a side portion of an area of the shoe sole located between said first concavely rounded portion of the sole inner surface and said second concavely rounded portion of the sole outer surface has a substantially uniform thickness extending to proximate a sidemost extent of a shoe sole side, as viewed in a frontal plane cross-section when the shoe sole is upright and in an unloaded condition.

7. A shoe sole as claimed in claim 5, wherein at least a first side portion of an area of the shoe sole located between said concavely rounded portion of the sole inner surface and said concavely rounded portion of the sole outer surface has a first substantially uniform thickness extending to proximate a sidemost extent of a shoe sole side, as viewed in a first frontal plane cross-section when the shoe sole is upright and in an unloaded condition, and at least a second side portion of an area of the shoe sole located between a concavely rounded portion of the sole inner surface and a concavely rounded portion of the sole outer surface has a second, different substantially uniform thickness extending to proximate a sidemost extent of a shoe sole side, as viewed in a second frontal plane cross-section when the shoe sole is upright and in an unloaded condition.

8. An athletic shoe sole for a shoe, the athletic shoe sole comprising:

a sole inner surface of an athletic shoe sole for supporting the foot of an intended wearer and a sole outer surface;

a sole heel area at a location substantially corresponding to the location of a heel of an intended wearer's foot when inside the shoe;

a sole forefoot area at a location substantially corresponding to the location of a forefoot of an intended wearer's foot when inside the shoe;

a sole midtarsal area located between the sole heel area and the sole forefoot area;

the sole heel, midtarsal, and forefoot areas having a sole medial side, a sole lateral side, and a sole middle part located between the sole sides, as viewed in a shoe sole frontal plane during a shoe unloaded, upright condition;

the sole lateral side including a sidemost lateral section located outside of a straight vertical line extending through the sole lateral side at the sidemost extent of the sole inner surface of the sole lateral side, as viewed in the shoe sole frontal plane during an unloaded, upright shoe condition;

the sole medial side including a sidemost medial section located outside of a straight vertical line extending through the sole medial side at the sidemost extent of the sole inner surface of the sole medial side, as viewed in the shoe sole frontal plane during an unloaded, upright shoe condition;

a forefoot lift providing an increased shoe sole thickness in the sole forefoot area such that the sole forefoot area has a sole thickness that is greater than a sole thickness in the sole heel area, as viewed in a shoe sole sagittal plane, during an unloaded, upright shoe condition;

the thickness of the shoe sole being defined as the distance between the sole inner surface and the sole outer surface, as viewed in the sagittal plane during an unloaded, upright shoe condition;

the sole heel area including the following combined components: a midsole component and an outsole component, the inner and outer boundaries of the combined components being formed by said sole inner and outer surfaces, as viewed in the shoe sole frontal plane during an unloaded, upright shoe condition;

the sole inner surface and the sole outer surface of one of the sole medial and lateral sides of the sole heel area each including a concavely rounded portion, as viewed in a shoe sole frontal plane during an unloaded, upright shoe condition, the concavity existing with respect to an intended wearer's foot location in the shoe;

the concavely rounded portion of the sole outer surface extending through a lowermost part of the sole side, as viewed in the shoe sole frontal plane during an unloaded, upright shoe condition;

said combined components extending into the sidemost section of at least the sole side of the sole heel area having the concavely rounded inner and outer surface portions, as viewed in the shoe sole frontal plane during an unloaded, upright shoe condition; and at least an upper part of the combined components that extend into the sidemost section of the sole side of the sole heel area having the concavely rounded inner and outer surface portions extending up the sole side at least to a height of a lowest point of the sole inner surface of the same sole side, as viewed in the shoe sole frontal plane during an upright, unloaded shoe condition.

9. The shoe sole according to claim 8, wherein at least an upper part of the combined components that extend into the sidemost section of the sole side of the sole heel area having the concavely rounded inner and outer surface portions extends up the sole side to above the height of the lowest point of the sole inner surface of the same sole side, as viewed in the shoe sole frontal plane during an upright, unloaded shoe condition.

10. The shoe sole according to claim 9, wherein the sole side portion located between the concavely rounded inner and outer surface portions has a thickness between the inner and outer surfaces that decreases gradually and continuously from a greatest thickness to a lesser thickness, as viewed in a horizontal plane during an upright, unloaded shoe condition; and the sole outer surface of the same sole side portion is also substantially concavely rounded, as viewed in a shoe sole horizontal plane during an upright, unloaded shoe condition, the concavity existing with respect to a centerline of the shoe sole.

11. The shoe sole according to claim 10, wherein the combined components of the sole heel area also include a forefoot lift.

12. A shoe sole as claimed in claim 8, wherein at least a side portion of an area of the shoe sole located between said concavely rounded portion of the sole inner surface and said concavely rounded portion of the sole outer surface has a substantially uniform thickness extending to proximate a sidemost extent of a shoe sole side, as viewed in a frontal plane cross-section when the shoe sole is upright and in an unloaded condition.

13. A shoe sole as claimed in claim 8, wherein at least a side portion of an area of the shoe sole located between said concavely rounded portion of the sole inner surface and said concavely rounded portion of the sole outer surface has a substantially uniform thickness extending through an arc of at least 30 degrees, as viewed in a frontal plane cross-section when the shoe sole is upright and in an unloaded condition.

14. A shoe sole as claimed in claim 8, wherein at least a side portion of an area of the shoe sole located between said concavely rounded portion of the sole inner surface and said concavely rounded portion of the sole outer surface has a substantially uniform thickness extending through an arc of at least 30 degrees, as viewed in a frontal plane cross-section when the shoe sole is upright and in an unloaded condition.

15. A shoe sole as claimed in claim 8, wherein at least a first side portion of an area of the shoe sole located between said concavely rounded portion of the sole inner surface and said concavely rounded portion of the sole outer surface has a first substantially uniform thickness extending to proximate a sidemost extent of a shoe sole side, as viewed in a first frontal plane cross-section when the shoe sole is upright and in an unloaded condition, and at least a second side portion of an area of the shoe sole located between a concavely rounded portion of the sole inner surface and a concavely rounded portion of the sole outer surface has a second, different substantially uniform thickness extending to proximate a sidemost extent of a shoe sole side, as viewed in a second frontal plane cross-section when the shoe sole is upright and in an unloaded condition.

16. An athletic shoe sole for a shoe, the athletic shoe sole comprising:

a sole inner surface of an athletic shoe sole for supporting the foot of an intended wearer and a sole outer surface;

a sole heel area at a location substantially corresponding to the location of a heel of the intended wearer's foot when inside the shoe;

a sole forefoot area at a location substantially corresponding to the location of a forefoot of the intended wearer's foot when inside the shoe;

a sole midtarsal area located between the sole heel area and the sole forefoot area;

the sole heel, midtarsal, and forefoot areas each having a sole medial side, a sole lateral side, and a sole middle part located between the sole sides, as viewed in a shoe sole frontal plane during a shoe unloaded, upright condition;

the sole lateral side including a sidemost lateral section located outside of a straight vertical line extending through the sole lateral side at the sidemost extent of the sole inner surface of the sole lateral side, as viewed in the shoe sole frontal plane during an unloaded, upright shoe condition;

the sole medial side including a sidemost medial section located outside of a straight vertical line extending through the sole medial side at the sidemost extent of the sole inner surface of the sole medial side, as viewed in the shoe sole frontal plane during an unloaded, upright shoe condition;

the sole forefoot area including the following combined components: a forefoot lift, a midsole component and an outsole component, the inner and outer boundaries of the combined components being formed by said sole inner and outer surfaces, as viewed in the shoe sole frontal plane during an unloaded, upright shoe condition;

the forefoot lift providing an increased shoe sole thickness in the sole forefoot area such that the sole forefoot area has a thickness that is greater than a thickness in the sole heel area, as viewed in a shoe sole sagittal plane, during an unloaded, upright shoe condition;

the thickness of the shoe sole being defined as the distance between the sole inner surface and the sole outer surface, as viewed in the sagittal plane during an unloaded, upright shoe condition;

the sole inner surface and the sole outer surface of one of the sole medial and lateral sides of the sole forefoot area each including a concavely rounded portion, as viewed in a shoe sole frontal plane during an unloaded, upright shoe condition, the concavity existing with respect to an intended wearer's foot location in the shoe;

the concavely rounded portion of the outer surface extending through a lowermost part of the sole side, as viewed in the shoe sole frontal plane during an unloaded, upright shoe condition;

at least one of the combined components extending into the sidemost section of at least the sole side of the sole forefoot area having the concavely rounded inner and outer surface portions, as viewed in the shoe sole frontal plane during an unloaded, upright shoe condition; and at least an upper part of the at least one combined component that extends into the sidemost section of the sole side of the sole forefoot area having the concavely rounded inner and outer surface portions extending up the sole side at least to a height of a lowest point of the sole inner surface of the same sole side, as viewed in the shoe sole frontal plane during an upright, unloaded shoe condition.

17. The shoe sole as claimed in claim 16 wherein the sole outer surface of the sole middle part of the sole forefoot area has an indentation, as viewed in the shoe sole frontal plane during an unloaded, upright shoe condition.

18. The shoe sole according to claim 17, wherein the sole side portion located between concavely rounded inner and outer surface portions has a thickness between the inner and outer surfaces that decreases gradually and continuously from a greatest thickness to a lesser thickness, as viewed in a horizontal plane during an upright, unloaded shoe condition; and the sole outer surface of the same sole portion is also substantially concavely rounded, as viewed in a shoe sole horizontal plane during an upright, unloaded shoe condition, the concavity existing with respect to a centerline of the shoe sole.

19. The shoe sole according to claim 16, wherein at least an upper part of the at least one combined component that extends into the sidemost section of the sole side of the sole heel area having the concavely rounded inner and outer surface portions extends up the sole side to above the height of a lowest point of the sole inner surface of the same sole side, as viewed in the shoe sole frontal plane during an upright, unloaded shoe condition.

20. The shoe sole according to claim 16 wherein the sole inner surface of the sole forefoot area is formed by the forefoot lift, the forefoot lift extending into the sidemost section of the sole side of the sole forefoot area having the concavely rounded inner and outer surface portions and above the height of the lowest point of the sole inner surface of the same sole side, as viewed in the shoe sole frontal plane during an upright, unloaded shoe condition.

21. A shoe sole as claimed in claim 16, wherein at least a side portion of an area of the shoe sole located between said concavely rounded portion of the sole inner surface and said concavely rounded portion of the sole outer surface has a substantially uniform thickness extending to proximate a sidemost extent of a shoe sole side, as viewed in a frontal plane cross-section when the shoe sole is upright and in an unloaded condition.

22. A shoe sole as claimed in claim 16, wherein at least a side portion of an area of the shoe sole located between said concavely rounded portion of the sole inner surface and said concavely rounded portion of the sole outer surface has a substantially uniform thickness extending through an arc of at least 30 degrees, as viewed in a frontal plane cross-section when the shoe sole is upright and in an unloaded condition.

23. A shoe sole as claimed in claim 16, wherein at least a first side portion of an area of the shoe sole located between said concavely rounded portion of the sole inner surface and said concavely rounded portion of the sole outer surface has a first substantially uniform thickness extending to proximate a sidemost extent of a shoe sole side, as viewed in a first frontal plane cross-section when the shoe sole is upright and in an unloaded condition, and at least a second side portion of an area of the shoe sole located between a concavely rounded portion of the sole inner surface and a concavely rounded portion of the sole outer surface has a second, different substantially uniform thickness extending to proximate a sidemost extent of a shoe sole side, as viewed in a second frontal plane cross-section when the shoe sole is upright and in an unloaded condition.

24. An athletic shoe sole for a shoe, the athletic shoe sole comprising:

a sole inner surface of an athletic shoe sole for supporting the foot of an intended wearer and a sole outer surface;

a sole heel area at a location substantially corresponding to a heel of the intended wearer's foot when inside the shoe;

a sole forefoot area at a location substantially corresponding to a forefoot of the intended wearer's foot when inside the shoe;

a sole midtarsal area at a location substantially corresponding to the area between the heel and the forefoot of the intended wearer's foot when inside the shoe;

the sole heel, midtarsal, and forefoot areas having a sole medial side, a sole lateral side, and a sole middle part located between the sole sides, as viewed in a shoe sole frontal plane during a shoe unloaded, upright condition;

the sole lateral side including a sidemost lateral section at a location outside of a straight vertical line extending though the sole lateral side at the sidemost extent of the sole inner surface of the sole lateral side, as viewed in the shoe sole frontal plane during an unloaded, upright shoe condition;

the sole medial side including a sidemost medial section at a location outside of a straight vertical line extending though the sole medial side at the sidemost extent of the sole inner surface of the sole medial side, as viewed in the shoe sole frontal plane during an unloaded, upright shoe condition;

the sole midtarsal area including the following combined components: a forefoot lift component, a midsole component, and an outsole component, the inner and outer boundaries of the combined components being formed by said sole inner and outer surfaces, as viewed in the shoe sole frontal plane during an unloaded, upright shoe condition;

the forefoot lift providing an increased shoe sole thickness in the sole forefoot area such that the sole forefoot area has a thickness that is greater than a thickness in the sole heel area, as viewed in a shoe sole sagittal plane, during an unloaded, upright shoe condition;

the thickness of the shoe sole being defined as the distance between the sole inner surface and the sole outer surface, as viewed in a shoe sole sagittal plane, during an unloaded, upright shoe condition;

the sole inner surface and the sole outer surface of one of the sole medial and lateral sides of the sole midtarsal area each including a concavely rounded portion, as viewed in a shoe sole frontal plane during an unloaded, upright shoe condition, the concavity existing with respect to an intended wearer's foot location inside the shoe;

the concavely rounded portion of the sole outer surface extending through a part of the same sole side, as viewed in the shoe sole frontal plane during an unloaded, upright shoe condition, the concavity existing with respect to an intended wearer's foot location inside the shoe;

at least one of said combined components extending into the sidemost section of at least the sole side of the sole midtarsal area having the concavely rounded inner and outer surface portions, as viewed in the shoe sole frontal plane during an unloaded, upright shoe condition; and at least an upper part of the at least one combined component extending into the sidemost section of the sole side of the sole midtarsal area having the concavely rounded inner and outer surface portions extends up the sole side at least to a height of a lowest point of the sole inner surface of the same sole side, as viewed in the shoe sole frontal plane during an upright, unloaded shoe condition.

25. The athletic shoe sole as claimed in claim 24, wherein the sole outer surface of at least part of the midtarsal area is substantially convexly rounded, as viewed in a shoe sole sagittal plane during an unloaded, upright shoe condition, the concavity existing with respect to an intended wearer's foot location in the shoe.

26. The shoe sole according to claim 25, wherein the sole side portion located between the concavely rounded inner and outer surface portions has a thickness between the inner and outer surfaces that decreases gradually and continuously from a greatest thickness to a lesser thickness, as viewed in a horizontal plane during an upright, unloaded shoe condition; and the sole outer surface of the same sole side portion is also substantially concavely rounded, as viewed in a shoe sole horizontal plane during an upright, unloaded shoe condition, the concavity existing with respect to a centerline of the shoe sole.

27. The shoe sole according to claim 24, wherein the upper part of the at least one combined component that extends into the sidemost section of the sole side of the sole heel area having the concavely rounded inner and outer surface portions extends up the sole side to above the height of the lowest point of the sole inner surface of the same sole side, as viewed in the shoe sole frontal plane during an upright, unloaded shoe condition.

28. The shoe sole according to claim 24, wherein the sole inner surface of the sole midtarsal area is formed by the forefoot lift, the forefoot lift extending into the sidemost section of the sole side of the sole midtarsal area having concavely rounded inner and outer surface portions and to a height above the height of the lowest point of the sole inner surface of the same sole side, as viewed in the shoe sole frontal plane during an upright, unloaded shoe condition.

29. A shoe sole as claimed in claim 24, wherein at least a side portion of an area of the shoe sole located between said first concavely rounded portion of the sole inner surface and said second concavely rounded portion of the sole outer surface has a substantially uniform thickness extending to proximate a sidemost extent of a shoe sole side, as viewed in a frontal plane cross-section when the shoe sole is upright and in an unloaded condition.

30. A shoe sole as claimed in claim 24, wherein at least a side portion of an area of the shoe sole located between said concavely rounded portion of the sole inner surface and said concavely rounded portion of the sole outer surface has a substantially uniform thickness extending through an arc of at least 30 degrees, as viewed in a frontal plane cross-section when the shoe sole is upright and in an unloaded condition.

31. A shoe sole as claimed in claim 24, wherein at least a first side portion of an area of the shoe sole located between said concavely rounded portion of the sole inner surface and said concavely rounded portion of the sole outer surface has a first substantially uniform thickness extending to proximate a sidemost extent of a shoe sole side, as viewed in a first frontal plane cross-section when the shoe sole is upright and in an unloaded condition, and at least a second side portion of an area of the shoe sole located between a concavely rounded portion of the sole inner surface and a concavely rounded portion of the sole outer surface has a second, different substantially uniform thickness extending to proximate a sidemost extent of a shoe sole side, as viewed in a second frontal plane cross-section when the shoe sole is upright and in an unloaded condition.

* * * * *